US006032472A

United States Patent [19]

Heinrichs et al.

[11] Patent Number: 6,032,472

[45] Date of Patent: Mar. 7, 2000

[54] MOTOR COOLING IN A REFRIGERATION SYSTEM

[75] Inventors: Anton D. Heinrichs, Ransomville; Stanley R. Grant, Baldwinsville, both of N.Y.

[73] Assignee: Carrier Corporation, Syracuse, N.Y.

[21] Appl. No.: 08/568,146

[22] Filed: Dec. 6, 1995

[51] Int. Cl.[7] ..... F25B 5/00; F25B 31/00

[52] U.S. Cl. ..... 62/199; 62/211; 62/505

[58] Field of Search ..... 62/505, 211, 213, 62/223, 513, 199

[56] References Cited

U.S. PATENT DOCUMENTS

| | | | |
|---|---|---|---|
| 3,913,346 | 10/1975 | Moody, Jr. et al. | 62/197 |
| 4,899,555 | 2/1990 | Shaw | 62/505 |
| 4,947,655 | 8/1990 | Shaw | 62/505 |
| 5,095,712 | 3/1992 | Narreau | 62/113 |
| 5,475,985 | 12/1995 | Narreau et al. | 62/117 |

FOREIGN PATENT DOCUMENTS

| | | | |
|---|---|---|---|
| 4043261 | 2/1992 | Japan | 62/505 |

*Primary Examiner*—William Wayner

[57] ABSTRACT

The expanded flow through a heat exchanger type economizer is controlled by an electronic expansion valve and is supplied to the motor of a motor compressor to cool the motor. The electronic expansion valve is controlled by a microprocessor responsive to the temperature of the motor winding sensed by a thermistor.

4 Claims, 1 Drawing Sheet

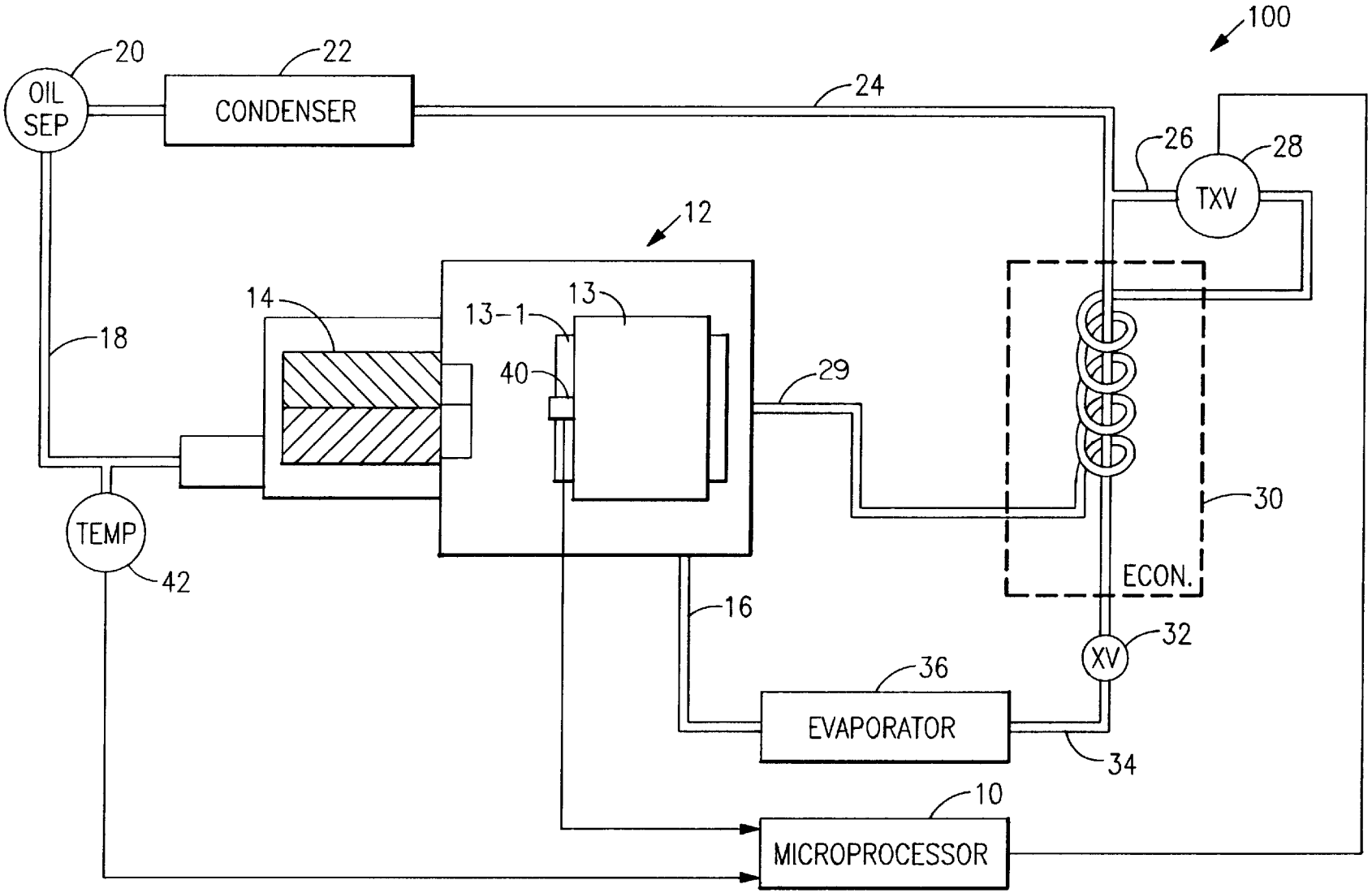
100
28
TXV
26
30
ECON.
32
XV
34
24
29
36
EVAPORATOR
10
MICROPROCESSOR
12
16
13
13-1
40
22
CONDENSER
14
20
OIL SEP
18
TEMP
42

MOTOR COOLING IN A REFRIGERATION SYSTEM

BACKGROUND OF THE INVENTION

In refrigeration or air conditioning systems, motor operating temperature is typically controlled in one of three ways. First is suction gas cooled which can be employed where the suction gas flow rate is sufficiently high and the temperature is sufficiently low that an appropriate motor operating temperature can be maintained by heat transfer between the hot motor and the cold suction gas. Second is discharge gas cooled where the discharge gas temperature controlled motor is typically controlled by maintaining adequate discharge flow rate and discharge temperature below the maximum safe operating temperature of the motor. Depending upon the condition, liquid injection is commonly utilized to augment discharge temperature control. Third is economizer gas cooled. Economizers are typically controlled by relying on the saturation pressure and superheat for control of the vapor going to the compressor. In some cases, a flash economizer is utilized with vapor theoretically at the saturation temperature. However, the flow rate and temperature differential between the motor to be cooled and the economized vapor is inadequate to keep the motor sufficiently cool for reliable operation. In such cases when economizer vapor is inadequate to keep the motor cool, flooding of the economizer is employed, i.e. liquid refrigerant is allowed to be entrained with the vapor to provide additional cooling. The problem that this presents is that no device is available which can accurately maintain the mixture of liquid and vapor to yield a specific outcome as it relates to the motor temperature that is to be controlled.

Commonly assigned U.S. Pat. No. 5,582,022, filed May 18, 1995 which is a continuation-in-part of U.S. patent application Ser. No. 08/167,467, filed Dec. 14, 1993, and now abandoned, and U.S. Pat. No. 5,475,985 each disclose structure for motor cooling.

SUMMARY OF THE INVENTION

The traditional thermal expansion valve or device, TXV, in the economizer line is replaced with an electronic expansion valve or device, EXV, whose opening and closing is signaled by the demands of the motor for more or less cooling as the case may demand. The motor signals its requirement for cooling through sensors embedded in the motor windings. This process is an active control mechanism as the sensor will signal a microprocessor which will cause the EXV to open and close based upon the input it receives. This approach permits expansion of the operating range with economized controlled motors to areas in which the compressor was previously restricted due to the need of previous expansion devices for superheat in the economized vapor for control. Additionally, this approach can be utilized to control the discharge temperature by utilizing a second temperature sensing device in the discharge line. The temperature signals will be setup to control in a manner that gives priority to whichever sensor is considered most critical since both motor temperature control and discharge temperature control results from control of the same economizer flow.

It is an object of this invention to control motor temperature.

It is another object of this invention to provide motor cooling in an economized motor cooled application. These objects, and others as will become apparent hereinafter, are accomplished by the present invention.

Basically, an EXV controls the economizer flow into a heat exchange type of economizer which is subsequently fed to the motor for cooling. The EXV is controlled by a microprocessor responsive to the sensed temperature of the motor windings.

BRIEF DESCRIPTION OF THE DRAWING

For a fuller understanding of the present invention, reference should now be made to the following detailed description thereof taken in conjunction with the accompanying drawing wherein:

The FIGURE is a schematic representation of a refrigeration system employing the motor cooling structure of the present invention.

DESCRIPTION OF THE PREFERRED EMBODIMENT

In the FIGURE, the numeral 100 generally indicates a refrigeration or air conditioning system having motor cooling controlled by microprocessor 10. Motor-compressor 12 includes motor 13 and compressor 14. Compressor 14 which is illustrated as a screw compressor is driven by motor 13 and receives gaseous refrigerant via suction line 16 and discharges hot, high pressure gas via line 18 and oil separator 20 to condenser 22. The output of condenser 22 is supplied via line 24 to heat exchanger economizer 30 and passes through expansion valve, XV, 32, which may be either a TXV or EXV, and low pressure refrigerant is supplied via line 34 to evaporator 36 which is connected to motor-compressor 12 via suction line 16.

Line 26 branches from line 24 upstream of economizer 30. Line 26 contains EXV 28 which controls flow through line 26 into economizer 30 in heat exchange relationship with line 24 prior to being supplied as a refrigerant gas/liquid mixture via line 29 to motor-compressor 12 to cool the motor. EXV 28 is controlled by microprocessor 10 which receives a signal representative of the motor temperature from thermistor 40 which is located in or on the windings 13-1 of the motor 13. Microprocessor 10 may also receive a signal representative of the compressor discharge temperature from thermistor 42.

In operation, the motor 13 of motor-compressor 12 drives the compressor 14 causing gas to be drawn into the compressor via suction line 16. The gas is compressed and heated by the compressor 14 and discharged into line 18. The hot high pressure gas passes through oil separator 20 which removes entrained oil and the oil free refrigerant gas flow into condenser 22 where the hot, high pressure gaseous refrigerant is condensed. The condensed refrigerant is supplied via line 24 to heat exchanger type economizer 30. Flow from economizer 30 is supplied to expansion valve 32 which expands the liquid refrigerant and supplies it via line 34 to evaporator 36 where low pressure liquid/gaseous refrigerant takes up heat and the liquid refrigerant changes to a gas. EXV 28 is in line 26 and when EXV 28 is open a portion of the liquid refrigerant from line 24 flows into line 26, is expanded in flowing through EXV 28, picks up heat from the refrigerant in line 24 flowing through economizer 30 and then flows via line 29 into motor-compressor 12. The gas/liquid refrigerant flow through line 29 serves to control the temperature of motor 13 based upon the degree to which EXV 28 is opened. The degree of opening of EXV 28 is under the control of microprocessor 10 responsive to the temperature sensed by thermistor 40. This flow also serves to lower compressor discharge temperature so that microprocessor 10 may also control EXV 28 responsive to the compressor discharge temperature sensed by thermistor 42. Control of EXV 28 is responsive to the temperature of the motor sensed by thermistor 40 so that EXV 28 is a temperature only operated expansion valve and controls the economizer flow rate and gas quality for optimum performance and motor cooling. This should be contrasted to the traditional pressure/temperature control schemes which are unsatisfactory in the present system due to the lack of a difference between saturation temperature and actual temperature i.e. superheated vapor is required by a conventional TXV. Because motor cooling and discharge temperature are related, microprocessor 10 may also control EXV 28 to control the discharge temperature as sensed by thermistor 42, as noted above.

Although preferred embodiment of the present invention has been described and illustrated, other changes will occur to those skilled in the art. It is therefore intended that the scope of the present invention is to be limited only by the scope of the appended claims.

What is claimed is:

1. A closed refrigeration system serially including a motor-compressor, a discharge line, a condenser, a heat exchanger economizer, an expansion device, an evaporator and a suction line, and temperature control means comprising:

means for sensing a parameter representative of operating temperature of said motor;

means for supplying an expanded flow through said economizer to said motor of said motor-compressor for cooling said motor;

means for controlling said means for supplying an expanded refrigerant flow responsive to said means for sensing.

2. The refrigeration system of claim 1 wherein said means for supplying includes an electronic expansion valve.

3. The refrigeration system of claim 1 further including means for sensing temperature in said discharge line and said means for controlling is also responsive to said means for sensing temperature in said discharge line.

4. The refrigeration system of claim 1 wherein said compressor of said motor-compressor is a single stage compressor and said expanded flow through said economizer is supplied initially to said motor of said motor compressor.

* * * * *